United States Patent [19]

Finney

[11] Patent Number: 4,984,799

[45] Date of Patent: Jan. 15, 1991

[54] GOLF CLUBHEAD WITH A CORNER-BACK SYSTEM OF WEIGHT DISTRIBUTION

[76] Inventor: Clifton D. Finney, 4057 Oak Hills Pkwy., Baton Rouge, La. 70810

[21] Appl. No.: 413,632

[22] Filed: Sep. 28, 1989

[51] Int. Cl.[5] ..... A63B 53/04

[52] U.S. Cl. ..... 273/169; 273/167 F; 273/173

[58] Field of Search ..... 273/167–175, 273/77 R, 77 A, 193 R, 194 R, 163 R, 163 A, 164; D21/214–220

[56] References Cited

U.S. PATENT DOCUMENTS

| | | | |
|---|---|---|---|
| D. 202,715 | 2/1965 | Solheim | D21/219 |
| D. 203,512 | 1/1966 | Solheim | D21/219 |
| D. 246,329 | 11/1977 | Little | D21/219 |
| D. 263,409 | 3/1982 | Duclos | D21/219 |
| D. 301,907 | 6/1989 | Muta | D21/220 |
| D. 306,629 | 3/1990 | Shearer | D21/219 |
| 3,847,399 | 11/1974 | Raymont | 273/169 |
| 3,873,094 | 3/1975 | Sebo et al. | 273/163 R |
| 3,941,390 | 3/1976 | Hussey | 273/169 |
| 3,966,210 | 6/1976 | Rozmus | 273/167 F |
| 4,063,733 | 12/1977 | Benedict | 273/80 C |
| 4,444,395 | 4/1984 | Reiss | 273/171 |
| 4,508,350 | 4/1985 | Duclos | 273/169 X |
| 4,607,846 | 8/1986 | Perkins | 273/171 |
| 4,693,478 | 9/1987 | Long | 273/164 |
| 4,714,252 | 12/1987 | Roraback | 273/171 |
| 4,762,324 | 8/1988 | Anderson | 273/164 |
| 4,824,110 | 4/1989 | Kobayashi | 273/78 |
| 4,824,115 | 4/1989 | Walther | 273/169 |
| 4,826,172 | 5/1989 | Antonious | 273/169 |
| 4,828,266 | 5/1989 | Tunstall | 273/171 |
| 4,834,387 | 5/1989 | Waites et al. | 273/164 |

FOREIGN PATENT DOCUMENTS

| | | | |
|---|---|---|---|
| 7279 | of 1901 | United Kingdom | 273/167 F |
| 1232651 | 5/1971 | United Kingdom | 273/171 |

OTHER PUBLICATIONS

"Golf World" Magazine, (Jul. 2, 1976 Issue), p. 31. bottom row at left.

"Golf World" Magazine. (Jan. 15, 1988) p. 37.

"Golf Digest" Magazine, Jun. 1976 Issue, p. 30.

*Primary Examiner*—Benjamin Layno

*Assistant Examiner*—Sebastiano Passaniti

[57] ABSTRACT

A golf clubhead includes a lower density body with a corner-back system of higher density weights. In its basic form the corner-back system has a weight in each corner of the golf clubhead. In other forms the weights may be variously joined, one or more may be deleted, or there may be more than four. The basic form of the corner-back system may be viewed as having a double split of a head weight. The first split yields a toe wieght and a heel weight to reduce twisting along the vertical twist axis. The second split yields upper and lower toe weights and upper and lower heel weights to reduce twisting along the horizontal loft axis. The corner-back system offers a designer an opportunity to optimize moments of inertia along both the vertical twist and the horizontal loft axes. The degree of optimization along either axis is a matter of choice. The quantization of the weights into a double split arises because of constraints by the clubhead's center of mass. The center of mass should be neither too high on nor too far behind the striking face. Mass-bit computations were performed on two near-clubheads. The first had a lower density aluminum body and a corner-back system of higher density tunsten weights. The second had a corner-back configuration with body and weights all of moderate density beryllium copper. The A1-W system had a 40 percent larger moment across the vertical twist axis and a 98 percent larger moment across the horizontal loft axis than the BeCu system. Thus, a head with a lower density body and a corner-back system of higher density weights may be regarded as more inertially efficient than a head in a simple corner-back configuration with body and weights all of one moderate density.

20 Claims, 5 Drawing Sheets

GOLF CLUBHEAD WITH A CORNER-BACK SYSTEM OF WEIGHT DISTRIBUTION

BACKGROUND--FIELD OF INVENTION

This invention relates to weighted golf clubheads with more highly enhanced moments of inertia along both the vertical twist and the horizontal loft axes through the geometric center of the striking face to reduce twisting and loft changes, respectively, when a golf ball is struck.

BACKGROUND--CROSS-REFERENCE TO RELATED APPLICATIONS

The present work is a continuation-in-part application of the parent entitled "A Golf Clubhead in a Corner-Back Configuration," filed May 31, 1989 under Ser. No. 07/359,109. In turn, the parent is a continuation-in-part application of the grandparent entitled, "A Golf Clubhead with a High Polar Moment of Inertia," filed Dec. 27, 1988 under Ser. No. 07/289,908, and issued as U.S. Pat. No. 4,898,387 on Feb. 6, 1990.

BACKGROUND--BRIEF DESCRIPTION OF PREVIOUS WORK

The concept of inertial efficiency, introduced in the grandparent, has significant implications for the placement of the mass of a golf clubhead. For considerations of twisting about a vertical axis through the geometric center of a ball striking surface, the inertial efficiency $E_y$ has been given as:

$$E_y = I_{a,y}/I_{t,y} \qquad \text{(EQN. 1a).}$$

Here $I_{a,y}$ is the actual moment of inertia, and $I_{t,y}$ is the theoretical moment inertia where both are referenced to the y- or twist-axis through the geometric center. These two moments may be simultaneously determined for an entire clubhead, or for a part of a clubhead such as a toe section, or for even lesser subsections such as upper and lower toe sections.

It is well known that actual moments of inertia, $I_{a,y}$, increase dramatically with length. For a bar or near-clubhead with a mass, m, of 300 grams and a length, 1, of four inches, the moment ($I_{a,y}=1/12\ ml^2$) is 2,580 g-cm$^2$. At five inches (5") long, it becomes 4,030 g-cm$^2$. At six inches (6") long, it increases to 5,810 g-cm$^2$.

The theoretical moment of inertia, $I_{t,y}$, is the moment the clubhead would have if its mass were divided in two with the half-masses placed at pinpoints a clubhead length apart and moment determined through a vertical axis at the midpoint. This theoretical moment of inertia ($I_{t,y}=\frac{1}{4}\ ml^2$) also increases dramatically with clubhead length. For a 300 gram bar or near-clubhead that is four inches (4") long, it is 7,740 g-cm$^2$. At five inches (5") long, it becomes 12,100 g-cm$^2$. At six inches (6") long, it increases to 17,400 g-cm$^2$.

However, by performing the respective divisions at each length in the preceeding examples, it is seen that the inertial efficiency, $E_y$, is constant at 0.33 over the entire four to six inch (4"-6") range.

Since inertial efficiency is itself independent of total clubhead mass and length, its enhancement represents a pathway other than increasing total clubhead mass and length for increasing the total moment of inertia of a golf clubhead, or the moment of inertia for a section or subsection thereto. For example, we can ask how the 300 gram bar or near-clubhead at five inches might be restructured so that the actual moment of 4,030 g-cm$^2$ could be increased to something more closely approaching its theoretical heel-to-toe limit of 12,100 g-cm$^2$?

In ideal terms it is seen that positioning half the mass at the heel and and half the mass at the toe as respective pinpoints would accomplish the task perfectly giving an inertial efficiency of a hundred percent. However, there are two inescapable problems with such an idealization. First, at least some of the mass must be left behind and devoted to structurally supporting a ball striking surface, and second, since real mass occupies space, the positioning of the mass carried forward as inertial weights near the heel and toe, respectively, must involve something more than pinpoints of space.

Thus, in a first approximation, it can be said that the separation of mass should be as great as possible consistent with the requirements for structural strength, aesthetics, and clubhead feel as a ball is struck. As to the pinpoints at the heel and toe, respectively, these could become thin sheets of weight positioned perpendicular to the length line of the clubhead. It is seen that the higher the density of these sheets, the thinner they might be.

It is also seen that the lower the density of the structural material related to the ball striking face, the greater the possible separation of mass. Hence, it becomes desirable to have the density of the clubhead's bodily material as low as possible and the density of clubhead's weight material as high as possible.

In a next approximation, the reality of the limited space available in the regions of the heel and toe, respectively, for the weights must be taken into account. Here, the center of mass of the clubhead comes into play as a constraint. Although there is some latitude, it is generally considered desirable to keep the center of mass of a clubhead relatively forward to the striking face and low to the ground. A low position for the center of mass may help to promote a clean sharp collision with a ball and yield an upward trajectory on the flight of the ball after a collision. The constraint by the center of mass translates into a constraint on the shape and position of a weight.

Thus, in one-dimension it was seen that the toe weight translated from a conceptual pinpoint, to an idealized expanded surface, and finally to a real wall-like configuration toward the extreme position of the toe. The transition from a highly expanded surface to a wall-like configuration was necessary at a practical level to keep the center of mass from going too high or too far back on the clubhead as it would, say, with the thinnist of possible surfaces—a single layer of atoms, molecules, or the like.

Eventhough the transitions from pinpoints to expanded surfaces to wall-like configurations tended to cause the inertial efficiency to be somewhat less than a hundred percent, the gain over an unstructured club was still significant. It was shown, for example, that an aluminum-lead putter head 5.0 inches long, 2.0 inches wide, and 1.2 inches high had a moment of inertia (by formula) of 8,300 g-cm$^2$ at an inertial efficiency of 0.70. These values are about a factor of two greater than those for a simple straight bar of equivalent mass and length.

The one-dimensional concept of inertial efficiency introduced in the grandparent was extended to two dimensions in the parent where tilting about the horizontal loft-axis through the geometric center was also considered. The definition of this top-to-bottom inertial efficiency, $E_z$ was similar to $E_y$.

$$E_z = I_{a,z}/I_{t,z} \quad \text{(EQN. 1b).}$$

Now, however, $I_{a,z}$ determined about the horizontal loft axis through the geometric center of a ball striking surface. For a thin bar the formula is approximated by $I_{a,z} = 1/12\ mh^2$ where h is the height of the bar. The theoretical moment of inertia, $I_{t,z} = \frac{1}{4}\ mh^2$, is the moment the clubhead would have if its mass were divided in two with the half-masses placed at pinpoints a clubhead height apart and moment determined through a horizontal axis at the midpoint.

Simultaneous consideration of $E_y$ and $E_z$ in the parent yielded a golf clubhead in a corner-back configuration. In its basic form the corner-back design has an upper toe weight extending behind the striking face from the top corner. There may also be a lower toe weight extending behind the striking face from the bottom corner. Upper and lower heel weights may occupy similar positions on the heel. This simple form of the corner-back clubhead involves a double split of the weights. The first split involves positioning weights on the heel and toe, respectively to reduce twisting along the vertical twist axis. The second split involves positioning the respective toe and heel weights so that there are upper and lower toe weights together with upper and lower heel weights to reduce loft variations along the horizontal loft axis.

A comparison based on mass-bit computations of cavity-back and corner-back near-clubheads revealed a 33% greater moment about the vertical twist axis and an 88% greater moment about the horizontal loft axis for the corner-back configuration. This very large degree of loft stabilization is a primary advantage of a clubhead in a corner-back configuration. Because of their relatively low height and relatively thin bar-like shape, long iron and and many putter clubheads are very unstable along the loft axis. This fact goes a long way toward explaining why even expert golfers sometimes have difficulty in striking a ball with a long iron or putter.

The present work emphasizes continuing development of the corner-back clubhead of the parent by returning to a lower density body and a higher density weight material as outlined in the grandparent. In further contrast with the parent, more importance is placed upon the positioning of the weight material at the corners of the toe section of the clubhead, and less upon the configuration of the toe section itself.

Definitions for the length, width, and height of a clubhead soled in its normal address position which were provided in the grandparent are again retained. It is necessary to remember that height excludes any hosel and any neck. Definitions for the geometric center and the toe section are also retained.

Once again , the focus of effort will be placed upon the toe section. For the purposes of this work, the toe section will be sub-divided into an upper toe section and a lower toe section. These sub-sections are formed by a horizontal cut-plane through the geometric center of the clubhead as further defined within.

OBJECTS AND ADVANTAGES

Accordingly, the several objects and advantages of my invention begin with a golf clubhead comprising a body of a predetermined lower density and a head weight means comprising at least one head weight serving as inertial weight for the clubhead whereby each head weight is of a predetermined higher density greater than the lower density of the body.

Another object is to have a clubhead with a toe and heel, a front and back, and a top and a sole with an elongated ball striking surface toward the front.

Too, an object is to have a binding means to attach the head weight means to the clubhead; and to have a fastening means to affix a shaft between between the heel and toe of the clubhead.

Yet another object is to have a geometric center of the ball striking surface with a vertical twist axis and a horizontal loft axis through the geometric center.

Still another object is to have a clubhead with a toe section and a heel section.

Another object is to have a clubhead with a toe weight means comprising at least one toe weight of the portion of the head weight means in the toe section as inertial weight for the toe section.

Too, another object is to have a toe weight distribution means to position: (i) a substantial quantity of the mass of the toe weight means away from the center of mass of the clubhead toward the toe; (ii) a first large percentage of this substantial quantity in the top corner region of the toe: (iii) a second large percentage of this substantial quantity in the bottom corner region of the toe; and (iv) a diminished percentage of this substantial quantity between the first large percentage in the top corner region and the second large percentage in the bottom corner region of the toe.

Yet another object is to have a ratio of masses between the mass the toe weight means and the complete mass of the toe section of at least 0.10; and a ratio of densities between the density of the toe weight mean and the density of the body in the toe section of at least 1.20.

Still another object is to have a ratio of masses between the mass the toe weight means and the complete mass of the toe section of at least 0.50; and a ratio of densities between the density of the toe weight means and the density of the body in the toe section of at least 4.0.

Another object is to have the material of the toe weight means with a density of at least 11.5 grams per cubic centimeter with a content of tungsten of at least 10 percent by weight.

Too, another object is to have the first large percentage of the substantial quantity of the toe weight means positioned in the top corner region of the toe including a first, at least partially, stratum-like configuration; and the second large percentage positioned in the bottom corner region of the toe including a second, at least partially, stratum-like configuration.

Yet another object is to have the first, at least partially, stratum-like configuration of the toe weight means extending in a proximity to the upper optimal edge of the toe; and the second, at least partially, stratum-like configuration of the toe weight means extending in a proximity to the lower optimal edge of the toe.

Still another object is to have a toe section of a clubhead with an upper toe section and a lower toe section.

Another object is to have an upper toe weight means comprising at least one upper toe weight of the portion of the toe weight means in the upper toe section as inertial weight for the upper toe section; and a lower toe weight means comprising at least one lower toe weight of the portion of the toe weight means in the lower toe section as inertial weight for the lower toe section.

Too, another object is to have a sectional weight distribution means to position: (i) a substantial quantity of the mass of the upper toe weight means in the upper toe section away from the center of mass of the clubhead toward the top corner region of the toe; and (ii) a substantial quantity of the mass of the lower toe weight means away from the center of mass of the clubhead toward the bottom corner region of the toe.

Yet another object is to have a golf clubhead whereby the mass of the upper toe weight means in the upper toe section is less than the mass of the lower toe weight means in the lower toe section to control the vertical location of the center of mass of the clubhead.

Still another object is to have a golf clubhead whereby the density of the of the upper toe weight means in the upper toe section is less than the density of the lower toe weight means in the lower toe section to control the vertical location of the center of mass of the clubhead.

Another object is to have a center of mass distribution means to position: (i) the center of mass of the upper toe weight means in the top corner region of the toe; and (ii) the center of mass of the lower toe weight means in the bottom corner region of the toe.

Too, another object is to have the upper toe weight means including a first, at least partially, stratum-like configuration positioned in the top corner region of the toe; and the lower toe weight means in the lower toe section including a second, at least partially, stratum-like configuration positioned in the bottom corner region of the toe.

Yet another object is to have the first, at least partially, stratum-like configuration of the upper toe weight means extending in a proximity to the upper optimal edge of the toe; and the second, at least partially, stratum like configuration of the lower toe weight means extending in a proximity to the lower optimal edge of the toe.

Still another object is to have a golf clubhead whereby the loft compression ratio of the upper toe weight means is at least 1.0 and the twist compression ratio of the upper toe weight means is at least 0.7; and the loft compression ratio of lower toe weight means is at least 1.0 and the twist compression ratio of the lower toe weight means is at least 0.7.

Another object is to have a golf clubhead whereby the polar moments of inertia along the vertical twist axis and horizontal loft axis are respectively enhanced.

Other objects and advantages of the current invention are to provide a golf clubhead that is not necessarily heavier, longer, broader, or higher than ordinary; yields a good solid feel when a ball is struck: is aesthetically appealing to golfers; is readily constructed with advanced technologies such as body casting; and is commercially attractive for both manufacturer and golfer.

Still more objects and advantages of my invention will become apparent from the drawings and ensuing description of it.

NUMERIC CODE

Figure 1:
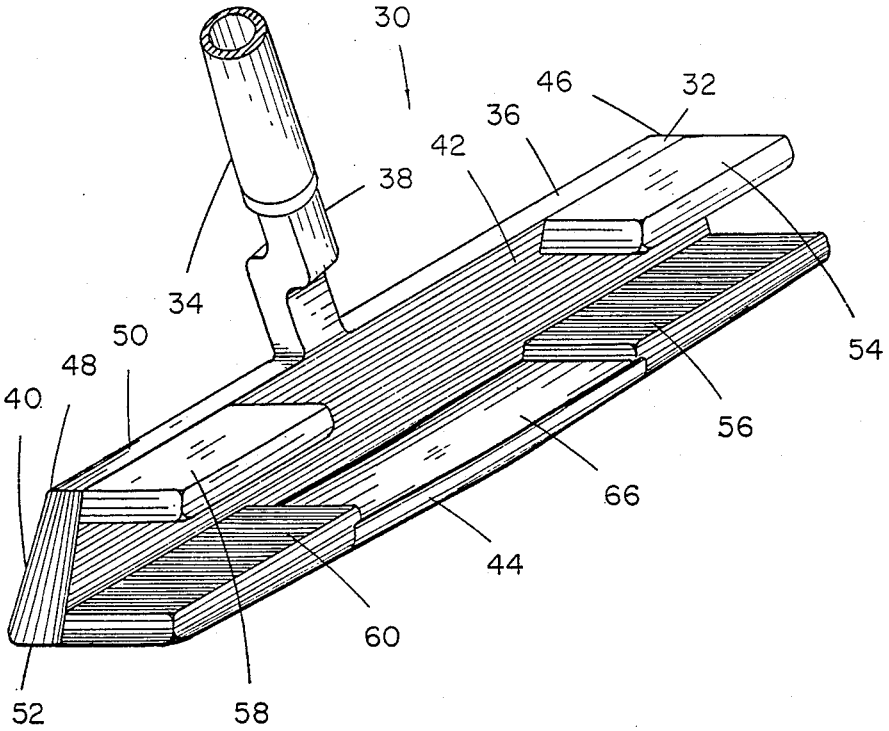
FIG. 1 is a perspective view of the clubhead of the present invention.

1–29 . . . FIGURES
30–99 . . . PARTS OF A PREFERRED EMBODIMENT–FIGS. 1–12
100–199 . . . POINTS–FIGS. 1–12
200–299 . . . AXES, LINES, SURFACES, AND ANGLES–FIGS. 1–12
300–399 . . . DIMENSIONS–FIGS. 1–12
400–499 . . . SCHEMATIC DIAGRAM–FIG. 13

PARTS OF A PREFERRED EMBODIMENT—FIGS. 1–12

30 golf club putter
32 head
34 shaft
36 body
38 hosel
**38*a*** arm
**38*b*** collar
**38*c*** neck
40 ball striking surface toward the front of head 32
42 rear surface
44 back
46 toe
**46*a*** upper optimal edge of toe
**46*b*** lower optimal edge of toe
48 heel
50 top
52 sole or bottom
54 upper toe weight
56 lower toe weight
58 upper heel weight
60 lower heel weight
62 male union for weight
64 female union for weight
66 extended sole
68 toe section
**68*a*** upper toe section
**68*b*** lower toe section
70 heel section

POINTS—FIGS. 1–12

100 geometric center of ball striking surface 40
102 center of golf ball circumference 202

104 center of mass of head 32
106 center of mass of upper toe weight 54
108 center of mass of lower toe weight 56

AXES, LINES, SURFACES, AND ANGLES—FIGS. 1-12

200 horizontal ground surface
202 circumference of a golf ball
204 horizontal loft or z-axis through geometric center 100 parallel to length line 300
206 vertical twist or y-axis through geometric center 100
208 horizontal x-axis through geometric center 100 perpendicular to horizontal loft axis 204 and vertical twist axis 206
210*a* partial circumference of a circle in a vertical plane perpendicular to length line 300 with horizontal loft axis 204 as center and length 318*a* as radius to reference center of mass 106 of upper toe weight 54
210*b* partial circumference of a circle in a vertical plane perpendicular to length line 300 with horizontal loft axis 204 as center and length 318*b* as radius to reference center of mass 108 of lower toe weight 56
212*a* partial circumference of a circle in a horizontal plane with vertical twist axis 206 as center and length 320*a* as radius to reference center of mass 106 of upper toe weight 54
212*b* partial circumference of a circle in a horizontal plane with vertical twist axis 206 as center and length 320*b* as radius to reference center of mass 108 of lower toe weight 56
214 angle of tilt or loft variation of head 32 when a ball as designated by circumference 202 is miss-struck a vertical length 314 off the preferred spot, here represented as geometric center 100
216 angle of twist of head 32 when a ball as designated by circumference 202 is miss-struck a horizontal length 316 off the preferred spot, here represented as geometric center 100

DIMENSIONS, FIGS. 1-12

As a reminder, each of the following definitions assume that head 32 is soled on ground surface 200 in its normal position for addressing the ball.

300 horizontal length of head 32 between vertical projections of imaginary parallel planes that are perpendicular to the length line and placed at extremes of toe 46 and heel 48, respectively
302 half the length 300 of head 32
304 vertical height of head 32 between horizontal projections of imaginary parallel planes placed at extremes of top 50, excluding hosel 38, and sole 52 on ground surface 200, respectively
306 half the height 304
308 horizontal width of head 32 between vertical projections of imaginary parallel planes from extreme toward ball striking surface 40 and extreme toward back 44 on a line perpendicular to 300
310*a* length of upper toe weight 54
310*b* width of upper toe weight 54
310*c* height of upper toe weight 54
312*a* length of lower toe weight 56
312*b* width of lower toe weight 56
312*c* height of lower toe weight 56
314 vertical length the center 102 of a golf ball as designated by circumference 202 is miss-struck off the preferred ball striking spot here represented as the geometric center 100
316 horizontal length the center 102 of a golf ball as designated by circumference 202 is miss-struck off the preferred ball striking spot here represented as the geometric center 100
318*a* direct length from horizontal loft or z-axis 204 to a horizontal projection from center of mass 106 of upper toe weight 54 wherein the projected line is parallel with z-axis 204
318*b* direct length from horizontal loft or z-axis 204 to a horizontal projection from center of mass 108 of lower toe weight 56 wherein the projected line is parallel with z-axis 204
320*a* direct length from vertical twist or y-axis 206 to a vertical projection of center of mass 106 of upper toe weight 54
320*b* direct length from vertical twist or y-axis 206 to a vertical projection of center of mass 108 of lower toe weight 56

SCHEMATIC DIAGRAM—FIG. 13

450 near-clubhead
452 toe
454 heel
456 horizontal facial edge
458 vertical facial edge
460 rear surface
461 body
462 upper toe weight
463 upper optimal edge of toe 452
464 lower toe weight
465 lower optimal edge of toe 452
466 upper heel weight
467 upper optimal edge of heel 454
468 lower heel weight
469 lower optimal edge of heel 454
470 vertical axis through geometric center of potential striking surface
472 horizontal axis through geometric center of potential striking surface parallel with length line 474
474 length of near-clubhead
476 width of near-clubhead
478 height of near-clubhead
480 length of a weight
482 width of a weight
484 height of a weight

DETAILED DESCRIPTION OF A PREFERRED EMBODIMENT

In FIG. 1 number 30 refers to a golf club putter of the current invention. It has a head 32 to which a separate shaft 34 is fastened to body 36 through hosel 38 with adhesive. On head 32 there is also a ball striking surface 40 toward the front which may be seen more directly in FIG. 2. Behind ball striking surface 40 are rear surface 42 and back 44. Head 32 also has a toe 46, a heel 48, a top 50, and a bottom, or sole 52. In this embodiment ball striking surface 40 is positioned at the extreme front of head 32. In equally acceptable embodiments, other components, hosel 38 for example, may be positioned at the extreme front of head 32.

The objects of the current invention center around the weight distribution at the corners of head 32. In this regard there are upper and lower toe weights 54 and 56, respectively, and upper and lower heel weights 58 and 60, respectively. As seen in FIGS. 2 and 3 and 7 and 8, each of the weights has a male union 62 with which it joins a female union 64 on body 36. Thus, each weight is attached on rear surface 42 to tightly bind it to head 32. Lower toe weight 56 and lower heel weight 60 also have grooves by which they are braced by and adhesively bonded to extended sole 66. Weights 54, 56, 58, and 60 are head weights since they are positioned on head 32. In this case they constitute the head weight means for head 32, and they may be separated from each other as shown, or they may be interconnected in any combination. There may also be more than four head weights.

As depicted body 36 is a casting and includes all material from ball striking surface 40 at the front to back 44 except for that material in shaft 34; weights 54, 56, 58, and 60; and the adhesive. Body 36 is a lower density material such as an aluminum alloy and weights 54, 56, 58, and 60 are each of a higher density material such as a tungsten alloy.

However, a variety of other lower density materials including graphite and a variety of other higher density materials including lead would also be suitable. Body 36 ma also be constructed of a moderate density material such as steel with a higher density weight material of lead or tungsten alloy.

The guiding principle is one of a lower density body 36 with a higher density head weight means. The former should have a density as low as possible and the latter should have a density as high as possible in a given set of circumstances. It is also true that any head weights such as 54, 56, 58, and 60 need not be of the same material. For a head weight to be a head weight, the density of the inertial material need only be higher than the density of the bodily material.

Too, a head weight such as 54, 56, 58, and 60 may be made up of more than one distinct material and; similarly, a body such as 36 may be made up of more than one material. In these circumstances actual densities should be used and the paramount concern remains one of positioning relatively large concentrations of the mass of the toe section 68 in the top and bottom corner regions of the toe 46.

As shown body 36 is basically a blade with its width defined by the extreme of ball striking surface 40 toward the front and rear surface 42 toward the back 44. Body 36 also includes a hosel 38 and an extended sole 66. However, the particular configuration of body 36 is not critical to this invention. Instead for example, body 36 might be shaped like a traditional wood or a hollow iron.

Figure 2:
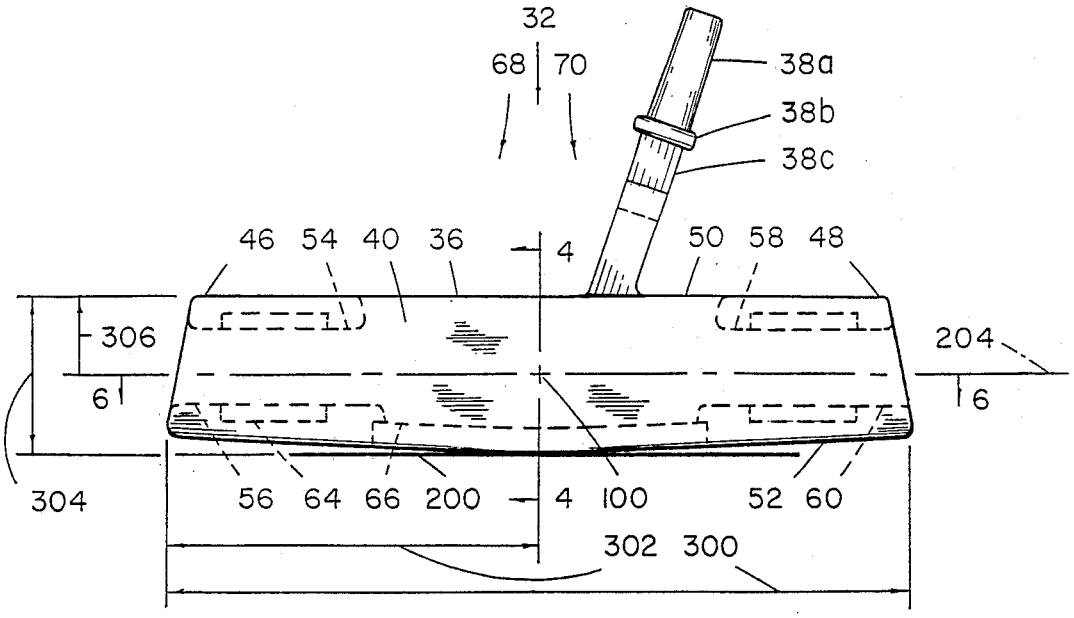
FIG. 2 is a front elevation view of the clubhead of FIG. 1.

With reference to the front elevation view of FIG. 2, clubhead 32 is resting in its normal address position on ground surface 200. The drawing displays all hidden lines of components of head 32 behind ball striking surface 40. Shaft 34 is deleted in this and following figures to illustrate more fully the details of hosel 38. It has an arm **38*a* onto which shaft 34 may slide, a retaining collar 38*b*, and a neck 38*c* which joins body 36 at top 50**.

Horizontal length 300 is the heel-to-toe length for head 32. Half-length 302 from the extreme of toe 46 is half the length 300. Half-length 302 defines the position of vertical cut-plane 4-4 which is perpendicular both to ground surface 200 and length line 300. Cut-plane 4-4 divides head 32 into a toe section 68 and a heel section 70. As seen in FIG. 2, hosel 38 accompanies the heel section 70. This will be true for all heel-shafted putter heads and for all heel-shafted irons, woods, and other utility clubs.

It will also be seen in FIG. 2 that head weights 54 and 56 are positioned in the toe section. These are also toe weights. Thus, any head weight material positioned on the toe side of cut-plane 4-4 is a toe weight whether or not it is physically joined to head weight material in the heel section. It follows from the discussion on head weights given above that toe weights 54 and 56 may be separated from each other as shown, or they may be interconnected to form one toe weight. There may also be more than two toe weights.

It is also apparent in FIGS. 1–12 that the toe weight means, here comprising weights 54 and 56, is distributed so as to position: (i) a substantial quantity of its mass away from the center of mass 104 of head 32 toward the toe 46; (ii) a first large percentage of this substantial quantity as upper toe weight 54 in the top corner region of the toe 46; (iii) a second large percentage of this substantial quantity as lower toe weight 56 in the bottom corner region of the toe 46; and (iv) a diminished percentage of this substantial quantity between the first large percentage as upper toe weight 54 in the top corner region and the second large percentage as lower toe weight 56 in the bottom corner region of toe 46.

In the same figures it is seen that the first large percentage of the substantial quantity of the toe weight means positioned in the top corner region of the toe includes a first, at least partially. stratum-like configuration; and the second large percentage positioned in the bottom corner region of the toe includes a second, at least partially, stratum-like configuration. The term stratum-like implies the conventional meaning of layer-like. While the stratum-like configurations of toe weights 54 and 56 closely approximate preferred rectangular parallelopipeds in the figures, this need not be the case. Instead, to recite only two of many possible other acceptable examples, these layer-like configurations, as viewed from the top in FIGS. 5 & 6, might be semi-circular or triangular with their respective bases seated on rear surface 42.

Also in FIG. 2, half-length 302 sets one of the coordinates for geometric center 100 on ball striking surface 40. The other coordinate for geometric center 100 is half-height 306 as referenced from top 50. It is half the vertical height 304 which is measured from the extreme of top 50 excluding hosel 38 to the extreme of sole 52 on ground surface 200. In this embodiment the highest point of head 32 is seen to be anywhere on top 50 excluding the region where top 50 and neck **38*c*** intersect.

This will not be true generally. On many iron clubheads the highest point on head 32 excluding hosel 38 will be near the toe end 46 of toe section 68. On many wood-type clubheads the highest point on head 32 excluding hosel 38 w 11 be in the central region of head 32 above and behind geometric center 100. Similarly, Long in U.S. Des. 248,783 dated Aug. 1, 1978 illustrated a putter head 32 which also has its highest point excluding hosel 38 in the central section behind geometric center 100. Thus, the many wood-type clubheads and Long's putterhead may be described as having dropped top corners at the toe 46 and heel 48. Similarly, most clubheads of all types have raised bottom corners at the toe 46 and heel 48 as shown in FIG. 2 to help prevent dragging on ground surface 200 as a ball is struck.

As well in FIG. 2, it is seen that the top corner of toe 46 is indented toward the central region of clubhead 32. On other putters, irons, and woods it is not unusual to have the bottom corner region of toe 46 indented instead. Thus, the corner regions of toe 46 may be dropped or elevated and indented or not indented at the will of the designer. In qualitative terms the top corner region is a region of the toe 46 toward the top 50, but it need not necessarily be at the extreme of either toe 46 or top 50. Similarly, the bottom corner region is a region of the toe 46 toward the sole 52, but it need not necessarily be at the extreme of either sole 52 or toe 46.

Half-height 306 also defines the position for horizontal cut-plane 6-6 placed perpendicular to height line 304 and parallel with ground surface 200. As well, horizontal loft or z-axis 204 passes through geometric center 100. Horizontal loft axis 204 is shown as an extension of horizontal cut-plane 6 6, and it is parallel with length line 300.

Figure 3:
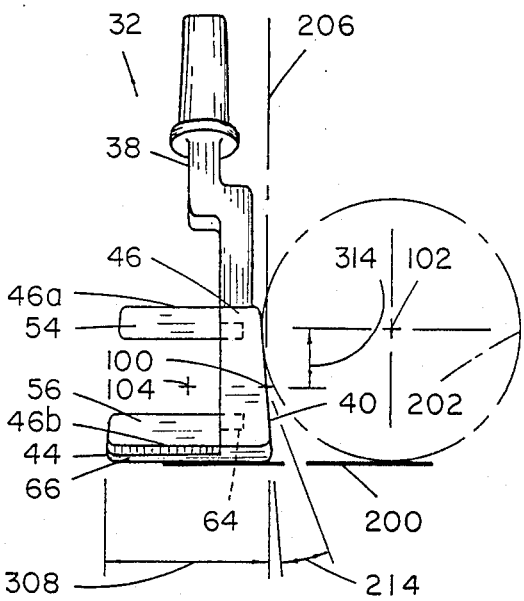
FIG. 3 is a side elevation view of the toe end of the clubhead of FIGS. 1 and 2.

FIG. 3 emphasizes the splitting of the weights 54 and 56 at the toe 46 of head 32. This perspective also provides a good view of the horizontal width 308 of head 32 in its normal address position as extended sole 66 rests on ground surface 200. As seen in FIGS. 2 and 3, the dimensions 300, 304, and 308 form a mutually perpendicular set.

Also shown in FIG. 3 are the geometric center 100 of ball striking surface 40 and the center of mass 104 of head 32. Vertical twist axis 206 through geometric center 100 is seen extending upward. In the figure, center of mass 104 is in a desirable location at slightly under the height of geometric center 100. Center of mass 104 may be adjusted by a variety of means such as a change in height 304 of head 32, a separate change in height of weight 54, a redistribution of mass between weights 54 and 56, and a redistribution of density between weights 54 and 56.

The relationship between ball striking surface 40 and its geometric center 100 relative to the circumference 202 of a golf ball and its center 102 is also shown in FIG. 3. The difference in vertical height 314 between centers 100 and 102 as well as the angle of loft variation 214 will be used in the explanation of the operation of the invention.

In FIG. 3, upper and lower optimal edges **46*a* and 46*b*, respectively, of toe 46 are also shown. A top view of these edges may be seen in FIG. 5. Optimal edges 46*a* and 46*b* are positioned toward the extreme of the toe 46 near the top 50 and bottom 52, respectively, and extend from the front-most position at ball striking surface 40 to the back-most position at back 44 of clubhead 32. These optimal edges represent approximate lines along which the mass of upper toe weight 54 and lower toe weight 56 may be concentrated, respectively, to simultaneously enhance the moments of inertia and inertial efficiencies along horizontal loft axis 204 and vertical twist axis 206**.

Figure 5:
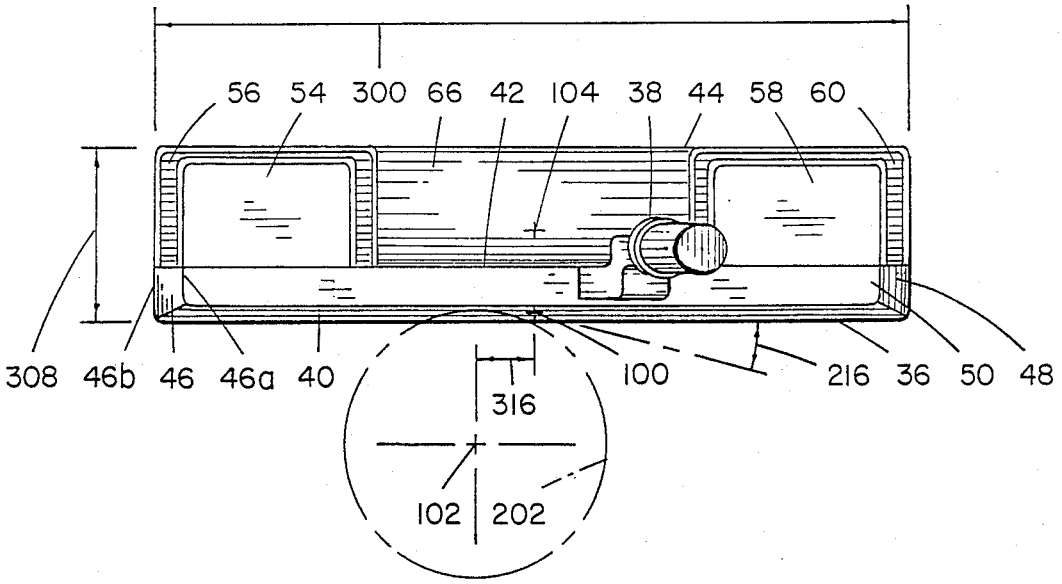
FIG. 5 is a top plan view of the clubhead of FIGS. 1–3.

In FIGS. 3 and 5 the first, at least partially, stratum-like configuration of the toe weight means, or upper toe weight 54, extends in proximity to upper optimal edge **46*a* of toe 46; and the second, at least partially, stratum-like configuration of the toe weight means or lower toe weight 56, extends in proximity to lower optimal edge 46*b* of the toe 46. Such a configuration represents a highly preferred embodiment of the present invention since the moments of inertia along both axes 204 and 206 will be enhanced. Less preferred embodiments of this invention where these conditions are met in a halfway fashion, or not all, may tend to exhibit less than optimal inertial characteristics. Examples of such less preferred, but still acceptable, embodiments have been given previously. They included triangular and semicircular weight members 54 and 56 as viewed from the top in FIG. 5**.

It was stated previously that the corner regions of toe 46 ma be dropped or elevated and indented o not indented at the will of the designer. A similar statement applies to the optimal edges **46*a* and 46*b*. In fact these optimal edges are closely related to their respective corner regions. Whereas an optimal edge is a one dimensional space, a corner region is a three dimensional space. Thus, the upper optimal edge 46*a* defines the uppermost limit toward the extreme of toe 46 of the top corner region, and the lower optimal edge 46*b* defines the lowermost limit toward the extreme of toe 46** of the bottom corner region.

Figure 4:
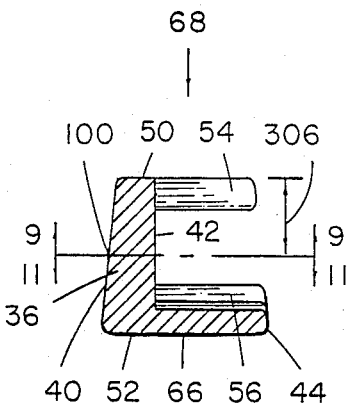
FIG. 4 is a cross-sectional side elevation view toward the toe end of the toe section of the clubhead of FIG. 2 as shown along the line 4—4.

The cross-sectional side view of FIG. 4 illustrates the toe section 68 of head 32 from a central perspective opposite that of the side elevation view of FIG. 3. Upper toe weight 54 and lower toe weight 56 are again seen projecting rearward toward back 44. Ball striking surface 40 is shown at its full height from the extreme of top 50 to the extreme of bottom 52 in the region of geometric center 100. The blade-type nature of body 36 between ball striking surface 40 and rear surface 42 is also manifest as is the relationship of extended sole 66 in body 36.

Figure 9:
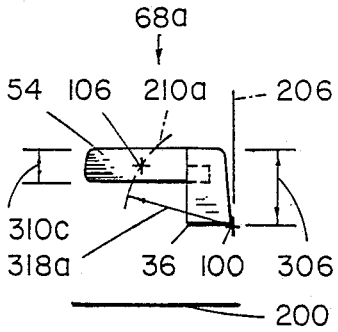
FIG. 9 is a side elevation view of the toe end of the upper toe section of the toe section of FIG. 4 as cut along the line 9—9.
Figure 10:
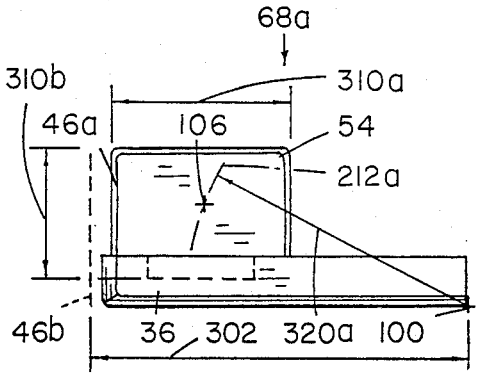
FIG. 10 is a top plan view of the upper toe section of FIG. 9.
Figure 11:
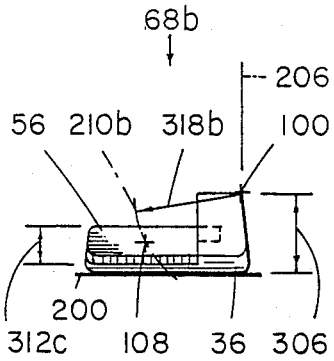
FIG. 11 is a side elevation view of the toe end of the lower toe section of the toe section of FIG. 4 as cut along the line 11—11.
Figure 12:
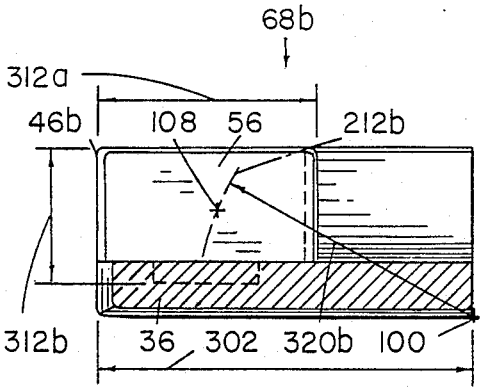
FIG. 12 is a top plan view of the lower toe section of FIG. 11.

Horizontal cut-plane 9-9 positioned a half-height 306 down from the extreme of top 50 of toe section 68 defines upper toe section **68*a* as seen in FIGS. 9 and 10. Horizontal cut-plane 11-11, similarly positioned, defines lower toe section 68*b* as seen in FIGS. 11 and 12**.

The top plan view of FIG. 5 illustrates details of head 32 as would be seen by a right-handed golfer about to make a stroke. Notably, the size of each of the upper weights 54 and 58 is seen to be less than that of their lower counterparts 56 and 60, respectively. As suggested earlier, the distribution of mass between upper and lower weights may be used to raise or lower the center of mass 104 of head 32. In FIG. 5 center of mass 104 is very slightly to the right of geometric center 100 due to the small contribution of hosel 38 in the heel section 70. Of course, the position toward either toe 46 or heel 48 of center of mass 104 may be adjusted generally through the distribution of mass between toe section 68 and heel section 70 and specifically through the distribution of mass between toe weights 54 and 56 and heel weights 58 and 60. Alignment indicators, not shown, may be added anywhere on head 32, but most probably on top 50 and extended sole 66.

Lastly in FIG. 5, there is another view of key dimensions and relationships. These include horizontal length 300 from the extreme of toe 46 to the extreme of heel 48 as well a horizontal width 308 from the extreme at the front of head 32 at ball striking surface 40 to the back 44. Also, the center 102 of golf ball circumference 202 is seen to be displaced a horizontal length 316 from geometric center 100 of ball striking surface 40. This, together with angle of twist 216, will be used in the explanation of the operation of the invention.

Figure 6:
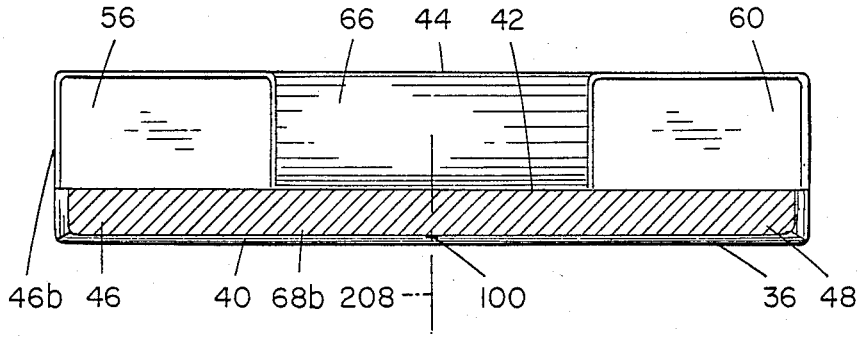
FIG. 6 is a top cross-sectional view of the clubhead of FIG. 2 as shown along line 6—6.

The top cross-sectional drawing of FIG. 6 illustrates the lower parts of toe and heel sections 68 and 70, respectively, as delineated by horizontal x-axis 208 through geometric center 100. The lower toe section **68*b* runs to the left from axis 208 to the extreme of toe 46 and from the extreme of the front at ball striking surface 40 to back 44. Once again, the blade-type body 36 between ball striking surface 40 and rear surface 42 is manifest. Of course, body 36 includes extended sole 66, and it also holds lower weights 56 and 60** in place.

Figure 7:
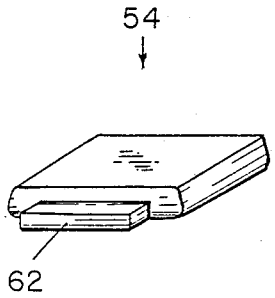
FIG. 7 is a perspective view of the upper toe weight.
Figure 8:
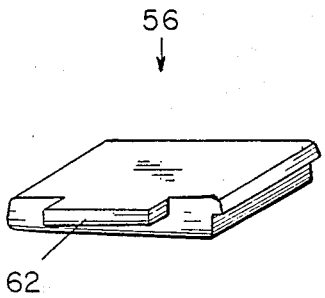
FIG. 8 is a perspective view of the lower toe weight.

FIG. 7 illustrates upper toe weight 54 and the detail of its male union 62. Similarly, FIG. 8 illustrates lower toe weight 56 and the detail of its male union 62. Also manifest in FIG. 8 is the groove at the lower right of weight 56. As stated earlier, extended sole 66 fits this groove and the two are adhesively bonded.

FIG. 9 presents a side elevation view of the upper toe section 68*a* of head 32. The perspective is similar to that for head 32 shown in FIG. 3. A horizontal projection parallel with loft axis 204 of the center of mass 106 of upper toe weight 54 is shown in relation to ground surface 200, geometric center 100, and vertical twist axis 206.

In viewing FIG. 9, it is important to remember that geometric center 100 and vertical twist axis 206 are at the rear of upper toe section 68*a*. Accordingly, the direct length 318*a* shown in the diagram is actually a radius from horizontal loft axis 204 to the partial circumference 210*a* through the projection of the center of mass 106 of upper toe weight 54.

However, horizontal loft axis 204 is hidden because it is perpendicular to the plane of page through geometric center 100. Under these circumstances, it appears that one end of direct length 318*a* is geometric center 100. Actually, the vertical plane upon which partial circumference 210*a* and direct length 318*a* exist is perpendicular to horizontal loft axis 204, and the center of mass 106 of upper toe weight 54 is projected perpendicularly onto to this plane.

Also shown in FIG. 9 are half-height 306 as referenced from geometric center 100 and the vertical height 310*c* of upper toe weight 54. The loft compression ratio of upper toe weight 54 is the ratio between direct length 318*a* and half-height 306. It is one of the key ratios of the current invention.

FIG. 10 presents a top plan view of the upper toe section 68*a*. The view is similar to that in FIG. 5. The drawing illustrates a vertical projection of center of mass 106 of upper toe weight 54 in relation to geometric center 100. In viewing FIG. 10 it is important to remember that geometric center 100 is below the projection of center of mass 106. Accordingly, the direct length 320*a* shown in the diagram is actually a radius from vertical twist axis 206 through geometric center 100 to the partial circumference 212*a* through the vertical projection of center of mass 106 of upper toe weight 54.

However, vertical twist axis 206 is hidden because it is perpendicular to the plane of the page through geometric center 100. Under these circumstances, it appears that one end of direct length 320*a* is geometric center 100. Actually, the horizontal plane upon which partial circumference 212*a* and direct length 320*a* exist is perpendicular to vertical twist axis 206, and the center of mass 106 of upper toe weight 54 is projected perpendicularly onto this plane.

Also shown in FIG. 10 are half-length 302 as referenced from geometric center 100 and the horizontal length 310*a* and width 310*b* of upper toe weight 54. A dashed line representing the lower optimal edge 46*b* is included in this diagram as a marker for the extreme point of half-length 302 of head 32 at the toe 46. The twist compression ratio of upper toe weight 54 is the ratio between direct length 320*a* and half-length 302. It is another of the key ratios of the current invention.

FIG. 11 presents a side elevation view of the lower toe section 68*b* of head 32. This perspective is also similar to that for head 32 shown in FIG. 3. A horizontal projection parallel with horizontal loft axis 204 of the center of mass 108 of the lower toe weight 56 is shown in relation to ground surface 200, geometric center 100, and vertical twist axis 206.

In viewing FIG. 11, it is also important to remember that geometric center 100 and vertical twist axis 206 are at the rear of lower toe section 68*b*. Accordingly, the direct length 318*b* shown in the diagram is actually the radius from horizontal loft axis 204 to the partial circumference 210*b* through the projection of the center of mass 108 of lower toe weight 56.

Once again, horizontal loft axis 204 is hidden because it is perpendicular to the plane of the page through geometric center 100. Under these circumstances, it appears that one end of direct length 318*b* is geometric center 100. Actually, the vertical plane upon which partial circumference 210*b* and direct length 318*b* exist is again perpendicular to horizontal loft axis 204, and the center of mass 108 of lower toe weight 56 is projected perpendicularly onto this plane.

Also shown in FIG. 11 are half-height 306 as referenced from geometric center 100 and the vertical height 312*c* of lower toe weight 56. The loft compression of lower toe weight 56 is the ratio between direct length 318*b* and half-height 306. It is yet another of the key ratios of the current invention.

FIG. 12 presents a top plan view of the lower toe section 68*b*. The perspective is similar to that of FIG. 5 except that upper toe section 68*a* has been cut away. The drawing illustrates a vertical projection of center of mass 108 of lower toe weight 56 in relation to geometric center 100. In viewing FIG. 12 it is important to remember that geometric center 100 is above lower toe weight 56. Accordingly, the direct length 320*b* shown in the diagram is actually a radius from geometric center 100 to the partial circumference 212*b* through the vertical projection of center of mass 108 of lower toe weight 56. Actually, the horizontal plane upon which partial circumference 212*b* and direct length 320*b* exist is perpendicular to the vertical projection of center of mass 108 of lower toe weight 56.

Also shown in FIG. 12 are half-length 302 as referenced from geometric center 100 and the horizontal length 312*a* and width 312*b* of lower toe weight 56. The twist compression ratio of lower toe weight 56 is the ratio between direct length 320*b* and half-length 302. It is still another of the key ratios of the current invention.

It was previously stated that toe weights 54 and 56 may be separated or they be interconnected to form only one such toe weight, or that there could be more than two such toe weights. Following this discussion it will be clear that any head weight material positioned above cut-plane 9-9 in FIG. 4 will be a part of an upper toe weight such as 54, and any head weight material positioned below cut-plane 11-11 in FIG. 4 will be part of a lower toe weight such as such as 56. Thus it also follows that there may be more than one such upper toe weight 54 and there may be more than one such lower toe weight 56.

It will also be apparent from FIGS. 9–12 that another object of the current invention is fulfilled: namely, there is an upper toe weight means comprising at least one upper toe weight 54 of the toe weight means in the upper toe section 68*a* serving as inertial weight for the upper toe section 68*a;* and there is a lower toe weight means comprising at least one lower toe weight 56 of that portion of the toe weight means in the lower toe section 68*b* serving as inertial weight for the lower toe section 68*b*.

Too, there is a sectional weight distribution means to position: (i) a substantial quantity of the mass of the upper toe weight means as upper toe weight 54 in the upper toe section 68*a* away from the center of mass 104 of head 32 toward the top corner region of the toe 46; and (ii) a substantial quantity of the mass of the lower toe weight means as lower toe weight 56 in the lower toe section 68*b* away from the center of mass 104 of head 32 toward the bottom corner region of toe 46.

There is also a center of mass distribution means to position: (i) the center of mass 106 of the upper toe weight means as upper toe weight 54 in the top corner region of the toe 46; and (ii) the center of mass 108 of the lower toe weight means as lower toe weight 56 in the bottom corner region of the toe 46.

Still another object is fulfilled since the upper toe weight means as upper toe weight 54 includes a first, at least partially, stratum-like configuration positioned in the top corner region of the toe 46; and the lower toe weight means as lower toe weight 56 includes a second, at least partially stratum-like configuration positioned in the bottom corner region of the toe 46.

Yet another object is completed since the first, at least partially, stratum-like configuration of the upper toe weight means as upper toe weight 54 extends in a proximity to the upper optimal edge 46*a* of the toe 46; and the second, at least partially, stratum-like configuration of the lower toe weight means as lower toe weight 56 extends in a proximity to the lower optimal edge 46*b* of the toe 46.

Still further insight into a definition for the term stratum-like or layer-like for simple cases may be discerned in FIGS. 9–12 and TABLE I. From the initial two figures and the table it is seen that both the length 310*a* and the width 310*b* are greater than the height 310*c* of upper toe weight 54. From the final two figures and the table it is seen that both the length 312*a* and the width 312*b* are greater than the height 312 of lower toe weight 56. While the condition of both length and width greater than height fulfills the condition of stratum-like or layer-like, it does not do so uniquely. As has been suggested, the upper and lower toe weight means may be multiple or they may be joined to each other as well as to other head weights in the heel section. Accordingly, the terms stratum-like or layer-like must be judged in the final analysis on a qualitatative basis.

The data in TABLE I will further assist in reviewing and understanding the invention. It is seen that head 32 has a total mass of 301 grams, a length 300 of 4.96 inches, a width 308 of 1.10 inch, and a height 304 of 1.00 inch. Hence, head 32 is not necessarily heavier, longer, broader, or higher than ordinary.

TABLE I

| Density, masses, dimensions, and critical ratios for a preferred embodiment similar to that in FIGS. 1–12. | |
|---|---|
| Density of aluminum in body 36 | 2.698 g/cm$^3$ |
| Density of tungsten-containing material* in weights 54, 56, 58, and 60 | 17.0 g/cm$^3$ |
| Mass of head 32 with hosel 38 | 301 g |
| Mass of body 36 with hosel 38 | 75.6 g |
| Mass of hosel 38 | 6.57 g |
| Mass of body 36 in toe section 68 | 34.5 g |
| Mass of body 36 in upper toe section 68a | 13.8 g |
| Mass of body 36 in lower toe section 68b | 20.7 g |
| Mass of upper toe weight 54 | 44.8 g |
| Mass of lower toe weight 56 | 67.9 g |
| Complete mass of toe section 68 | 147 g |
| Complete mass of upper toe section 68a | 58.7 g |
| Complete mass of lower toe section 68b | 88.6 g |
| Horizontal length 300 of head 32 | 4.96 in |

TABLE I-continued

| Density, masses, dimensions, and critical ratios for a preferred embodiment similar to that in FIGS. 1–12. | |
|---|---|
| Half-length of head 302 of head 32 | 2.48 in |
| Horizontal width 308 of head 32 | 1.10 in |
| Vertical height 304 of head 32 | 1.00 in |
| Half-height 306 of head of head 32 | 0.50 in |
| Horizontal length 310a of upper toe weight 54 | 1.18 in |
| Horizontal width 310b of upper toe weight 54 | 0.820 in |
| Vertical height 310c of upper toe weight 54 | 0.200 in |
| Horizontal length 312a of lower toe weight 56 | 1.44 in |
| Horizontal width 312b of lower toe weight 56 | 0.896 in |
| Vertical height 312c of lower toe weight 56 | 0.256 in |
| Direct length 318a | 0.722 in |
| Loft compression ratio for upper toe weight 54 | 1.44 |
| Direct length 320a | 1.85 in |
| Twist compression ratio for upper toe weight 54 | 0.746 |
| Direct length 318b | 0.723 in |
| Loft compression ratio for lower toe weight 56 | 1.45 |
| Direct length 320b | 1.85 in |
| Twist compression ratio for lower toe weight 56 | 0.746 |

*The tungsten-containing material may be any of a variety of forms comprising the solidified pure element available from Teledyne Wah Chang Huntsville, Huntsville, Alabama 35806; a relatively soft alloy such as Densalloy 5 available from Teledyne Powder Alloys, Clifton. New Jersey 07012: and a sintered species such as described by A. J. Williams in U.S. Pat. No. 3,305,235 dated February 21, 1967.

Combining the masses of upper toe weight 54 and lower toe weight 56 and dividing by the complete mass of the toe section 68 gives a ratio of 0.766. It is preferred to have a ratio of masses between the mass of the toe weight means and the complete mass of the toe section of at least 0.10. It is even more desirable to have a ratio of masses between the mass of the toe weight means and the complete mass of the toe section of at least 0.50.

Dividing the density of the material in weights 54 and 56 by the density of the material of the body 36 gives a ratio of 6.30. It is preferred to have a ratio of densities between the density of the toe weight means and the density of the body in the toe section 68 of at least 1.20. It is even more desirable to have a ratio of densities between the density of the toe weight means and the density of the body in the toe section 68 of at least 4.0.

As suggested by the sources listed for tungsten-containing material in the footnote to TABLE I, weights 54 and 56 may have tungsten contents varying over the full range from essentially zero to essentially a hundred percent. It is preferred to have a toe weight means with a density of to material of the toe weight means of at least 11.5 grams per cubic centimeter with a content of tungsten of least 10 percent by weight.

In TABLE I the mass of upper toe weight 54 of upper toe section 68*a* is seen to be about two thirds that of lower toe weight 56 of lower toe section 68*b*. It is preferred to have a golf clubhead 32 whereby the mass of the upper toe weight means in the upper toe section 68*a* is less than the mass of the lower toe weight means in the lower toe section 68*b* to control the vertical location of the center of mass 104 of clubhead 32.

It is of interest to further explore the variation in the vertical location of the center of mass 104 of head 32 as a function of the density of the material in the body 36 and the head weights 54, 56, 58, and 60. When the head 32 is made as indicated in FIGS. 1–12 and TABLE I, then the center of mass 104 is positioned at 0.49 inches above ground surface 200.

When head 32 including body 36 and head weights 54, 56, 58, and 60 is made of a single body casting of stainless steel at density 7.70 g/cm$^3$, then the center of mass 104 rises to 0.53 inches above ground surface 200.

For this case the total mass of the head increases slightly to 318 grams.

When head 32 has a body 36 of aluminum, upper head weights 54 and 58 are of Be-Cu at a density of 8.47 g/cm$^3$, and lower head weights 56 and 60 are of the tungsten-containing material at a density of 17.0 g/cm$^3$, then the center of mass 104 falls to 0.40 inches above ground surface 200. For this case the geometry of upper head weights 54 and 58 is retained as illustrated in FIGS. 1–12, but the height 310c of lower head weights 56 and 60 is increased by an amount sufficient to balance the reduction in mass of upper head weights 54 and 58, respectively. In other words, total mass is held constant at 301 grams. Accordingly, the density of the of the upper toe weight means in the upper toe section 68a is less than the density of the lower toe weight means in the lower toe section 68b to control the vertical location of the center of mass of the clubhead 32.

It is readily seen that there is a slight loss in the moment of inertia about both horizontal loft axis 204 and vertical twist axis 206 when the density of upper toe weight 54 is made less than the density of lower toe weight 56 as in the previous example. Thus, there is an unavoidable tradeoff between moments of inertia and controlling the position of the center of mass 104.

In TABLE I the loft compression ratio of upper toe weight 54, or the ratio between direct length 318a and half-height 306 in FIG. 9, and the loft compression ratio of lower toe weight 56, or the ratio between direct length 318b and half-height 306 in FIG. 11, pertain to an optimal moment of inertia and inertial efficiency about horizontal loft axis 204. In turn the twist compression ratio of upper toe weight 54, or the ratio between direct length 320a and half-length 302 in FIG. 10, and the twist compression ratio of lower toe weight 56, or the ratio between direct length 320b and half-length 302 in FIG. 12, pertain to an optimal moment of inertia and inertial efficiency about vertical twist axis 206. Qualitatively, the greater the ratio, the greater the moment of inertia and inertial efficiency about the respective axis. This assumes the mass of each of the toe weights 54 and 56 is constant. Too, the loft and twist compression ratios for upper toe weight 54 may be adjusted independently of the analogous ratios for lower toe weight 56.

However, for a given toe weight the loft and twist compression ratios are dependent on one another. The relationship between the loft and twist compression ratios may be explored as follows with upper toe weight 54 as the example. Suppose initially that the width 310b of upper toe weight 54 is held constant. To increase the loft compression ratio, we must increase the direct length 318a. Since width 310b is constant, this can be accomplished by decreasing the height 310c of upper toe weight 54 which means that its length 310a must increase. Accompanying these changes, is the fact that direct length 320a or the numerator of the twist compression ratio of upper toe weight 54, must decrease. In other words an increase in the loft compression ratio is gained at the expense of a decrease in the twist compression ratio. Hence, an increase in the moment of inertia the horizontal loft axis 204 is gained at the expense of a decrease in the moment of inertia about vertical twist axis 206. A similar argument may be presented to demonstrate that an increase in moment of inertia about vertical twist axis 206 is won at the expense of a decrease in the moment of inertia about horizontal loft axis 204.

When the restriction of a constant width for upper toe weight 54 is removed, and its width 310b is increased, both direct lengths 318a and 320a may be enhanced. Accordingly, both the compression ratios would increase. It is further noted that these ratios, individually or together, are enhanced by positioning the mass of upper toe weight 54 as much as possible toward the top corner region of toe 46. Furthermore, the farther upper toe weight 54 extends along upper optimal edge 46a, the greater the two moments of inertia.

In TABLE I the upper toe weight means as upper toe weight 54 has a loft compression ratio of 1.44 and a twist compression ratio of 0.746. In turn, the lower toe weight means as lower toe weight 56 has a loft compression ratio of 1.45 and a twist compression ratio of 0.746. It is preferred to have a golf clubhead 32 whereby the loft compression ratio of the upper toe weight means is at least 1.0 and twist compression ratio of the upper toe weight means is at least 0.7; and the loft compression ratio of the lower toe weight means is at least 1.0 and the twist compression ratio of the lower toe weight means is at least 0.7.

Lastly, increasing the mass of either or both upper toe weight 54 and lower toe weight 56 by removing additional mass from the body 36 of head 32 also presents options for enhancing the moments of inertia and inertial efficiencies along horizontal loft axis 204 and vertical twist axis 206. A similar comment applies to further enhancing the densities of upper toe weight 54 and lower toe weight 56 and reducing the density of body 36.

OPERATION OF THE INVENTION

The dynamics will be explained with reference t the schematic diagram in FIG. 13 and as necessary to the preferred embodiment in FIGS. 1–12. Formulas for estimating moments of inertia that were developed in the parent were used herein without modification. The algorithm Inertia presented in the parent was also used without modification. Similarly, the methods of applying the formulae and algorithm were similar to that described in the parent.

Figure 13:
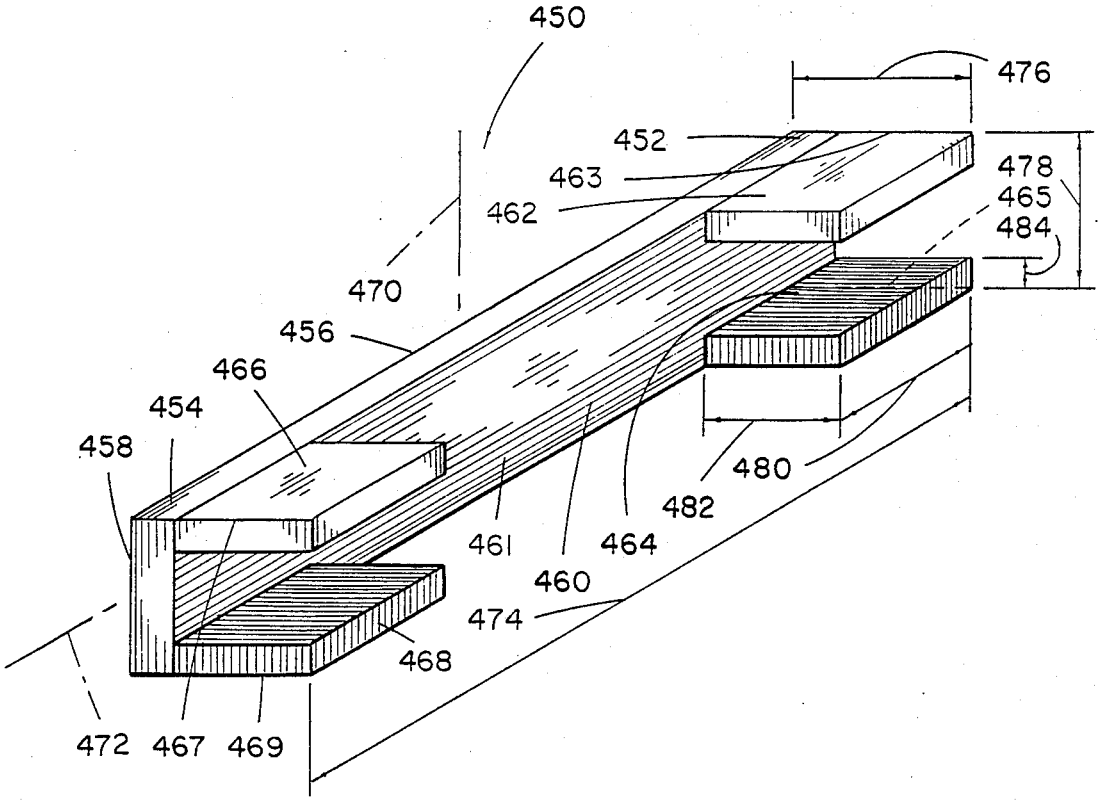
FIG. 13 is a schematic representation of a near-clubhead with a corner-back system of weight distribution.

FIG. 13 illustrates a near-clubhead 450 with a corner-back system of weight distribution. It has a toe 452 and a heel 454. The horizontal facial edge 456 and vertical facial edge 458 define a flat potential ball striking surface which is hidden from view in this perspective. Four weights are attached to rear surface 460 including: upper toe weight 462, lower toe weight 464, upper heel weight 466, and lower heel weight 468.

Vertical twist axis 470 is placed midway along horizontal facial edge 456, and horizontal loft axis 472 is placed midway along vertical facial edge 458. Near-clubhead 450 is generally characterized by a length 474, a width 476, and a height 478. More specifically, each of its weights has a length 480, a width 482, and a height 484.

The optimal edges 463 and 465 at the toe 452 and the optimal edges 467 and 469 at the heel 454 represent the intersection of two sets of imaginary planes. The first set of imaginary planes at the top and bottom of FIG. 13 is parallel with horizontal axis 472 and perpendicular to vertical axis 470. These planes represent the position upon which weight may be placed to optimize the moment of inertia about horizontal axis 472. The second set of imaginary planes at the toe 452 and heel 454 of FIG. 13 is perpendicular to horizontal axis 472 and parallel with vertical axis 470. These planes represent the position upon which weight may be placed to optimize the moment of inertia about vertical axis 470. Thus, the optimal edges 463 and 465 at the toe 452 and the optimal edges 467 and 469 at the heel 454 represent a solution along which weight may be placed to simultaneously optimize moments of inertia for both horizontal axis 472 and vertical axis 470 of near-clubhead 450.

The intersecting sets of imaginary planes arose out of an analysis at the limit of certain terms in EQNS. 10*a* and 10*b* of the parent. When, for example, $x=2$ and $l_{2,n}$ approaches $l_{3,n}$ in EQN. 10*a* and $h_{2,n}$ approaches $h_{3,n}$ in EQN. 10*b*, then the sets of planes exist. The actual corner-back system of weight distribution along the optimal edges arose because even high density mass occupies space and because of the limited width imposed upon the optimal edges by practical considerations of clubhead design. The center of mass 104 of a clubhead 32 cannot be too far behind the geometric center 100. Such constraints lead to a quantized double split of the system of weights in simple form. More complicated forms might include a split at the toe and none at the heel or various partial splits of the system of weights.

In TABLE II, the moments of inertia for near-clubheads 450 with two different corner-back systems of weight distribution are compared. The first as defined in Part A is made entirely of beryllium copper. The second as defined in Part B has a blade-type body 461 of aluminum and weights 462, 464, 466, and 468 of tungsten. Hence, the first has an intermediate density everywhere on near-clubhead 450, and the second has a lower density body 461 and higher density weights 462, 464, 466, and 468. As seen in Parts A and B, the dimensions of the two near-clubheads 450 are very nearly the same.

However in Part C of TABLE II it is seen that the moments of inertia and inertial efficiencies of the two systems do vary significantly, and two general conclusions may be drawn. Firstly, the values for Al-W system are superior to those for the BeCu system. Secondly, the more accurate values derived from the computations on mass-bits in parentheses are always greater than the corresponding values from the approximations with formulae.

This second conclusion is expected because of the finer resolution on distance measurements from the respective axis to the centers of mass. In other words the lengths used in the computations on mass-bits are equal to or larger than the approximate lengths used in the calculations with formulae.

TABLE II

Moments of inertia and inertial efficiencies for two 300 gram corner-back near-clubheads as seen in FIG. 13. The first in Part A is made entirely of BeCu alloy. The second in Part B has a blade of Al and weights of W. In Part C open values represent formula calculations, and values in parentheses are results from mass-bit computations.

| | |
|---|---|
| Part A. Critical parameters for BeCu system 450 in FIG. 13 | |
| 1. Density of BeCu | 8.47 g-cm$^3$ |
| 2. Length 474 | 5.000 in |
| 3. Width 422 | 1.189 in |
| 4. Height 478 | 1.000 in |
| 5. Length 480 | 1.000 in |
| 6. Width 482 | 0.901 in |
| 7. Height 484 | 0.200 in |
| Part B. Critical parameters Al—W system 450 in FIG. 13 | |
| 1. Density of Al | 2.698 g-cm$^3$ |
| 2. Density of W | 19.35 g-cm$^3$ |
| 1. Length 474 | 5.000 in |
| 2. Width 476 | 1.220 in |
| 3. Height 478 | 1.000 in |

TABLE II-continued

Moments of inertia and inertial efficiencies for two 300 gram corner-back near-clubheads as seen in FIG. 13. The first in Part A is made entirely of BeCu alloy. The second in Part B has a blade of Al and weights of W. In Part C open values represent formula calculations, and values in parentheses are results from mass-bit computations.

| | | | |
|---|---|---|---|
| 4. Length 480 | | 1.000 in | |
| 5. Width 482 | | 0.931 in | |
| 6. Height 484 | | 0.200 in | |
| Part C. Moments of Inertia and Inertial Efficiencies | | | |
| BeCu | | Al—W | |
| I (g-cm$^2$) | Efficiency | I (g-cm$^2$) | Efficiency |
| Vertical Twist Axis 470 | | | |
| 5,320 | 0.440 | 7080 | 0.585 |
| (5,750) | (0.475) | (8,070) | (0.667) |
| Horizontal Loft Axis 472 | | | |
| 213 | 0.440 | 283 | (0.585) |
| (641) | (1.330) | (1,270) | (2.620) |

In Part C of TABLE II for results about vertical twist axis 470, it is seen that the divergence between the two sets of values is small and well within the 20 percent range expected. However, for the results about horizontal loft axis 472, the divergence becomes much larger. An understanding of this phenomenon is straightforward. The height 478 of near-clubhead 450 is only a fraction its length 474. Accordingly, the relative distance error with the formulae become greater when the lesser height 478 is involved.

This same problem leads to inertial efficiencies greater than 1.0 about horizontal loft axis 472. As has been suggested previously in the parent, the argument could be made that the value for a true efficiency should not exceed 1.0. However, to retain the the concepts and methods as defined, the inertial efficiency could be regarded instead as an inertial evaluator or as an inertial coefficient.

The results from the mass-bit computations in Part C are particularly compelling regarding the superiority of Al-W system over the BeCu system. The moment of inertia across vertical twist axis 470 of the the Al-W system is 40 percent larger than that for the BeCu system. The moment of inertia across horizontal loft axis 472 of the Al-W system is 98 percent larger than that for the BeCu system. The huge increase across horizontal loft axis 472 is particularly significant since prior art clubheads have tended to have moments across this axis well below that of the BeCu system. Thus, a fundamental advantage of the corner-back system of weights is the enhanced stability across the loft axis, and thereby in controlling the distance a golf ball travels.

Since the golf clubhead 32 of the preferred embodiment as illustrated in FIGS. 1–12 has a system of weights of similar structure and position a the near-clubhead 450 in FIG. 13, it is readily apparent that the clubhead 32 also possesses superior moments of inertia along horizontal loft axis 204 and vertical twist axis 206.

With reference to FIG. 3 it will be seen that when the center 102 of a golf ball as represented by circumference 202 is miss-struck a vertical length 314 off the preferred spot, here represented as the geometric center 100 of the ball striking surface 40, the angle of tilt 214 of head 32 will tend to be diminished as a result of the improved moment of inertia along horizontal loft axis 204.

With reference to FIG. 5 it will be see that when center 102 is miss-struck a horizontal length 316 off the geometric center 100, the angle of twist 216 of head 32 will also tend to be diminished, this time as a result of the improved moment of inertia along vertical twist axis 206. Of course, when a ball is simultaneously miss-struck a vertical length 314 and a horizontal length 316, then angle of tilt 214 and the angle of twist 216 will both tend to be diminished for the reasons given above, respectively.

SCOPE, RAMIFICATIONS AND CONCLUSIONS

Thus, it may be recognized that the clubhead 32 with the corner-back system of weight distribution of the present invention is a general model for golf clubheads that are stabilized with regard to loft variations and twisting when a ball is struck. As the invention is primarily concerned with relative mass and density distributions as well as certain length ratios, a suitable clubhead can be made for any person of any size and age.

While my above description contains many specificities, these should not be construed as limitations of the scope of the invention, but rather as an exemplification of one preferred embodiment thereof. Many other variations are possible.

Also, it will be readily seen by persons familiar with the art and science of designing golf clubs that the principles, practices, variations, modifications, and equivalents of the preferred embodiment of this invention may be readily applied to all classes of clubs including as well other monofacial putters, bifacial putters, woods, irons, and utility clubs as included within the spirit and scope of the appended claims.

While parameters such as hosel position, loft, total weight, shaft length, and the grooves in the clubface may change from clubhead to clubhead, the appended claims do not relate to these parameters. Instead, they relate to the distribution of mass and density and to certain design ratios, primarily in the toe section of the clubhead. The distribution of mass and density and the design ratios are common to all all clubheads with a corner-back system of weights.

Accordingly, the position of hosel 38 is not critical to this invention. Head 32 may be center-shafted as illustrated in FIGS. 1–3 and 5; or it may be heel-shafted; or less likely, in the case of putters, it may even be toe-shafted. If a part or all of hosel 38 resides in the toe section 68, then its proportional contribution to the mass should be included in that section. A similar comment applies for upper toe section **68*a* and lower toe section 68*b*. In fact hosel 38 is optional as other known means such as a simple hole in head 32 would do to attach a shaft 34** in some circumstances.

It may be instructive to take this a step further and consider how the design of golf club putter 30 might be approximately modified so as to make it into an iron or wood. As seen especially in FIG. 2, ball striking surface 40 is trapezoidal in shape with the length across top 50 being slightly less than that across sole 52. For an iron or wood, these lengths might be reversed so that the length across top 50 would be greater than that across sole 52. As previously discussed, this amounts to reversing the indentation of head 32.

For both the iron and wood, hosel 38 would be strengthened and moved to the extreme region of heel 48. In the case of the iron, hosel 38 would most likely be positioned at the front in the region of ball striking surface 40. For the wood, hosel 38 might be positioned in the region between the ball striking surface 40 and the back 44. Other changes would be similar in kind for both the iron and wood as follows.

As is well known in the trade, the total mass of golf clubs is relatively constant throughout a set including putter, irons and woods, if anything, usually decreasing slightly through this progression. Accordingly as the length and mass of the shafts increase in progressing from putter, irons, and woods, the mass of the clubheads decrease proportionally.

Thus the iron or wood head would be made with less mass by an amount approximately in proportion to the increase in mass of the shaft for the iron or wood over that for the golf putter 30. Also, since the clubhead is now heel-shafted some mass would also be re-arranged between the toe weights 54 and 56 and the heel weights 58 and 60 so that there was something approximating a 60–40 percent split between the masses of the toe section 68 and the heel section 70, respectively. This combined with the fact that the lower weights 56 and 60 may be heavier than the respective upper weights 54 and 58 indicates that upper heel weight 58 might be made the lightest and lower toe weight 56 may be the heaviest of the four weights. Of course, upper heel weight 58 might be eliminated altogether and the invention would still retain its essential spirit as set forth in the appended claims. Also, the loft of clubhead 32 could be increased and appropriate grooves added to ball striking surface 40.

Too, the shape and size of the toe weights 54 and 56 might change somewhat in progressing from putter to wood to iron. However, the relative positioning of a substantial portion of their masses toward their respective corner of the clubhead would remain constant. Regarding changes in size, the weights 54 and 56 might be substantially smaller and less massive for clubheads 32 of the iron and wood type because of the greater need for structural strength, and thereby mass, in the body 36 and hosel 38. Also in some clubheads 32 of the iron type, the respective widths **310*b* and 312*b* of upper toe weight 54 and lower toe weight 56 might be substantially reduced because rearward projections from their traditionally thin blade-type bodies 36 might be unwanted. For this case the weights 54 and 56 might be entered into recesses in the body 36 parallel with the length parameter 300 in the top and bottom corner regions of the toe 46**, respectively.

However, it is seen that none of these changes would necessarily alter the basic distribution of mass, density and design ratios for the toe section 68 that define a clubhead 32 with a corner-back system of weight distribution. Therefore, these and any other modifications could be carried out in a relatively straightforward fashion.

In the parent it was stated that traditionally-shaped wood and iron clubs were beyond the scope of that invention. This included woods made of persimmon, maple, or laminated materials as constructed on a lathe. It also included modern hollow-back irons and woods made by body casting. The reason for this exclusion was that the parent was about the corner-back configuration itself. However, the present invention is about a corner-back system of weight distribution. Hence, while the weights must occupy corner positions as specified in the appended claims, the shape of the heads 32 may vary widely. Therefore, as indicated earlier, heads 32 may be of traditional shape, in a corner-back configuration, or of some other geometry.

Body casting with a metal is considered to be a highly preferred method of constructing a strong unitary version of the body 36 of this invention. However, as suggested earlier any manufacturing process and any materials or combination of materials of appropriate density capable of providing the desired combination of strength, durability, mass distribution, and design rations for a clubhead 32 with a corner-back system of weight distribution will be considered acceptable.

Similarly, head weights 54, 56, 58 and 60 could be joined to head 32 by means other than direct union with rear surface 42. As another acceptable possibility such a head weight could be separated entirely from rear surface 42 and attached in a similar position with a separate system of braces. As still another possibility, head weights 54, 56, 58, and 60 might be distributed so as to occupy similar positions on the inside of a hollow iron or wood clubhead 32. As yet another possibility, they might be distributed so as to occupy similar positions on the outside of a traditional wooden club.

Too the width of extended sole 66 is not critical to this invention. It may be narrower, wider, or even deleted altogether.

The absolute data on masses and dimensions for head 32 as set forth in TABLE I are not critical to the invention. For a small child's clubhead they might be less. For a large adult's clubhead might be more. It has also been shown that the corner-back system of weight distribution may have variability in the portioning of mass of mass between body 36 38, and head weights 52, 54, 56, and 58. However, some of the values of the percentages and ratios set forth in TABLE I are of importance because they are within the ranges set forth in the appended claims.

Similarly, the data in TABLE 11 should be regarded as a means to illustrate the theory as set forth in EQNS. 1-10b and the algorithms in the parent. This information is included with the hope that it will provide understanding and help to spur future developments. It also supports a key notion regarding moments of inertia and inertial theory. That notion is the inertial advantage along both horizontal loft axis 204 and vertical twist axis 206 of a clubhead 32 with a lower density body 36 in combination with a higher density corner-back system of weight distribution over a clubhead 32 with a moderate density body 36 in combination with a moderate density corner-back system of weight distribution.

The invention is not bound by the path of the development of the theory or the resultant theory itself beyond that necessary for the appended claims. Other starting points and other pathways, theoretical or purely empirical, could lead to a similar invention. In this case, the theory is regarded as an essentially separate entity that guided the definition of several empirical design ratios that are helpful in describing the invention. This empirical realm of ratios covers key masses, densities, and lengths.

In the grandparent and parent, some of the possible alternate positions and shapes for the toe weight means were discussed. Because of the higher degree of complexity of this invention there are essentially an infinite number of possible aternative shapes. Of primary importance in the present invention is the positioning of the toe weight means in the top and bottom corner regions of the toe as delineated precisely in the appended claims. Of secondary importance are the facts that the toe weight means may be shaped in the form of strata in the top and bottom corners and the fact that the strata may be positioned along the optimal edges. Since the toe weight means can be separated as with upper toe weight 54 and lower toe weight 56, or variously joined into one toe weight, or variously separated into more than two toe weights, certain terms also assume importance in the appended claims. These include: the centers of mass 104, 106, and 108; the terms clubhead and head weight means, toe section and toe weight means, upper toe section and upper toe weight means, and lower toe section and lower toe weight means Accordingly, the scope of the invention should not be determined by the embodiment illustrated, but by the appended claims and their legal equivalents.

The following material provides some alternative descriptions of details of head 32 as depicted in FIGS. 1-12.

In FIG. 2 the toe section 68 of clubhead 32 extends one-half the length 300, or half-length 302, of the clubhead 32 from the extreme of the toe 46 toward the heel 48 to a central boundary defined by vertical cut-plane 4-4 positioned perpendicularly to the length line 300 of the clubhead 32.

With reference to FIGS. 2 and 4, we may describe a modified toe weight distribution means. It positions between the ball striking surface 40 toward the front and the back 44: (i) a first substantial percentage of the toe weight means in the form of upper toe weight 54 as an increased upper concentration of mass in a predetermined fixed upper location adjacent the top 50 and the toe 46, and a second substantial percentage of the toe weight means in the form of lower toe weight 56 as an increased lower concentration of mass in a predetermined fixed lower location adjacent the sole 52 and the toe 46; (ii) a middle volume directly between the increased upper and lower concentrations having a decreased middle concentration of the toe weight means substantially less concentrated than each of the increased upper and lower concentrations to substantially separate the increased upper concentration as upper toe weight 54 from the increased lower concentration as lower toe weight 56; and (iii) an upper central volume directly between the increased upper concentration as upper toe weight 54 and the central boundary of the toe section 68 as vertical cut-plane 4-4 having a decreased upper central concentration of the toe weight means substantially less concentrated than the increased upper concentration tending to separate the increased upper concentration from the central boundary.

It is seen in FIGS. 2 and 4 that the first substantial percentage of the toe weight means in the form of upper toe weight 54 as an increased upper concentration of mass and the second substantial percentage of the toe weight means in the form of lower toe weight 56 as an increased lower concentration of mass together represent one hundred percent of the mass of the toe weight means. Too, the increased upper concentration of mass as upper toe weight 54 is completely separated from the increased lower concentration of mass as lower toe weight 56. Again, the central extent of the upper concentration as upper toe weight 54 is less than one-half the length 300, or half-length 302, from the extreme of the toe 46.

In Table I, the length **310*a*, width 310*b*, and height 310*c* of the increased upper concentration of mass as upper toe weight 54 are between about one-twentieth to one-third the length 300 of the clubhead 32, one-tenth to nine-tenths the width 308 of the clubhead 32, and one twentieth to one-third the height 304 of the clubhead 32, respectively. Too, both the length 310*a* and the width 310*b* of the increased upper concentration as upper toe weight 54 are greater than height 310c** of the upper toe weight means.

FIGS. 4 and 9–12 demonstrate that upper toe section 68a extends upwards and lower toe section 68b extends downward, respectively, from a horizontal boundary in the toe section 68 defined by horizontal cut-plane 9-9 or 11-11, respectively, positioned a one-half the height 304, or half-height 306, of the head 32 from the extreme of the top 50 of the clubhead 32.

Again with reference to FIGS. 2 and 4 together with FIGS. 9–12 we may describe a modified sectional weight distribution means. It positions between the ball striking surface 40 toward the front and the back 44: (i) a substantial percentage of the upper toe weight means in the form of upper toe weight 54 as an increased upper concentration of mass in a predetermined fixed upper location adjacent the top 50 and the toe 46, and a substantial percentage of the lower toe weight means in the form of lower toe weight 56 as an increased lower concentration of mass in a predetermined fixed lower location adjacent the sole 52 and the toe 46; (ii) a middle volume directly between the increased upper and lower concentrations having a decreased middle concentration of the toe weight means substantially less concentrated than each of the increased upper and lower concentrations to substantially separate the increased upper concentration in the form of upper toe weight 54 from the increased lower concentration in the form of lower toe weight 56; and (iii) an upper central volume directly between the increased upper concentration as upper toe weight 54 and the central boundary of the toe section 68 as vertical cut-plane 4-4 having a decreased concentration of the toe weight means substantially less concentrated than the increased upper concentration tending to separate the increased upper concentration from the central boundary.

In FIG. 2 the far extent toward the toe 46 of the increased upper concentration of mass as upper toe weight 54 of the upper toe weight means and the far extent toward the toe 46 of the increased lower concentration of mass as lower toe weight 56 of the lower toe weight means are each positioned within about one-fourth the length 300 of clubhead 32 from the extreme of the toe 46. The upper extent of the increased upper concentration as upper toe weight 54 toward the top 50 and the lower extent of the increased lower concentration as lower toe weight 56 toward the sole 52 are positioned within about one-fourth the height 304 of the clubhead 32 from the extremes of the top 50 and the sole 52 of the clubhead 32, respectively. Too, the substantial percentage of the upper toe weight means as the increased upper concentration of mass in the form of upper toe weight 54 and the substantial percentage of the lower toe weight means as the increased lower concentration of mass in the form of lower toe weight 56 represent one hundred percent of the mass of the toe weight means. The increased upper concentration of mass as upper toe weight 54 is completely separated from the increased lower concentration of mass as lower toe weight 56, and the lower extent of the increased upper concentration of mass as upper toe weight 54 toward the horizontal boundary defined by horizontal cut-plane 9-9 in FIG. 4 is less than one-half the height 304, or half-height 306, of clubhead 32 from the extreme of the top 50 of clubhead 32. Finally, the central extent of the increased upper concentration of mass as upper toe weight 54 of the upper toe weight means toward the central boundary of the toe section 68 defined by vertical cut-plane 4-4 is less than one-half the length 300, or half length 302, from the extreme of the toe 46.

As to FIGS. 2-3 and 5, there is an upper optimal edge 46a approximately parallel to the width line 308 of the clubhead 32 positioned adjacent the top 50 and the toe 46 within about one-fourth the height 304 of the clubhead 32 from the extreme of the top 50 and within about one-fourth the length 300 of clubhead 32 from the extreme of the toe 46, whereby the portion of the increased upper concentration as upper toe weight 54 of the upper toe weight means that is most adjacent the top 50 and toe 46 generally extends rearward along the upper optimal edge 46a. There is also a lower optimal edge 46b approximately parallel to the width line 308 of the clubhead 32 positioned adjacent the sole 52 and the toe 46 within about one-fourth the height 304 of the clubhead 32 from the extreme of the sole 52 and within about one-fourth the length 300 of the clubhead 32 from the extreme of the toe 46, whereby the portion of the increased lower concentration as lower toe weight 56 of the lower toe weight means that is most adjacent the sole 52 and the toe 46 generally extends rearward along the lower optimal edge.

In Table I, the length 310a, width 310b, and height 310c of the increased upper concentration of mass of the upper toe weight means as upper toe weight 54 are between about one-twentieth to one-third the length 300 of the clubhead 32, one-tenth to nine-tenths the width 308 of the clubhead 32, and one-twentieth to one-third the height 304 of the clubhead 32, respectively. Too, both the length 310a and the width 310b of the increased upper concentration of the upper toe weight means as upper toe weight 54 are greater than height 310c of the upper toe weight means.

What is claimed is:

1. A golf clubhead comprising:

a. a body of a predetermined lower density;

b. a head weight means comprising at least one head weight serving as inertial weight for said clubhead whereby each said head weight is of a predetermined higher density greater than said predetermined lower density of said body;

c. a toe and a heel, a front and a back, and a top and a sole with a ball striking surface toward said front;

d. a binding means to attach said head weight means to said clubhead;

e. a fastening means to affix a shaft between said heel and said toe;

g. a toe section of said clubhead extending one-half the length of said clubhead from an extreme of said toe toward said heel to a central boundary defined by a vertical cut-plane positioned perpendicularly to the length line of said clubhead;

h. a toe weight means comprising at least one toe weight of the portion of said head weight means in said toe section serving as inertial weight for said toe section;

i. a modified toe weight distribution to position between said ball striking surface toward said front and said back:

(i) a first substantial percentage of said toe weight means as an increased upper concentration of mass in a predetermined fixed upper location adjacent said top and said toe, and a second substantial percentage of said toe weight means as an increased lower concentration of mass in a predetermined fixed lower location adjacent said sole and said toe;

(ii) a middle volume directly between said increased upper and lower concentrations of mass having a decreased middle concentration of said toe weight means substantially less concentrated than each of said increased upper and lower concentrations to substantially separate said increased upper concentration from said increased lower concentration; and (iii) an upper central volume directly between said increased upper concentration and said central boundary of said toe section having a decreased upper central concentration of said toe weight means substantially less concentrated than said increased upper concentration tending to separate said increased upper concentration from said central boundary; whereby j. polar moments of inertia of said clubhead are enhanced.

2. The golf clubhead of claim 1 having a ratio of masses between the mass of said toe weight means and the complete mass of said toe section of at least 0.10; and having a ratio of densities between the density of said toe weight means and the density of said body in said toe section of at least 1.20.

3. The golf clubhead of claim 2 whereby said ratio masses is at least 0.50; and said ratio of densities is as least 4.0.

4. The golf clubhead of claim 2 whereby the density of the material of said toe weight means is at least 11.5 grams per cubic centimeter with a content of tungsten of at least 10 percent by weight.

5. The golf clubhead of claim 2 whereby:

a. said first substantial percentage of said toe weight means as said increased upper concentration of mass and said second substantial percentage of said toe weight means as said increased lower concentration of mass together represent one hundred percent of the mass of said toe weight means;

b. said increased upper concentration of mass is completely separated from said increased lower concentration of mass; and c. the central extent of said increased upper concentration toward said central boundary is less than one-half the length of said clubhead from the extreme of said toe.

6. The golf clubhead of claim 5 whereby the length, width, and height of said increased upper concentration of mass are between about one-twentieth to one-third the length of said clubhead, one-tenth to nine-tenths the width of said clubhead, and one-twentieth to one-third the height of said clubhead, respectively.

7. The golf clubhead of claim 6 whereby both the length and the width of said increased upper concentration are greater than the height of said increased upper concentration.

8. A golf clubhead comprising:

a. a body of a predetermined lower density;

b. a head weight means comprising at least one head weight serving as inertial weight for said clubhead whereby each said head weight is of a predetermined higher density greater than said predetermined lower density of said body;

c. a toe and a heel, a front and a back, and a top and a sole with a ball striking surface toward said front;

d. a binding means to attach said head weight means to said clubhead;

e. a fastening means to affix a shaft between said heel and said toe;

g. a toe section of said clubhead extending one-half the length of said clubhead from an extreme of said toe toward said heel to a central boundary defined by a vertical cut-plane positioned perpendicularly to the length line of said clubhead;

h. a toe weight means comprising at least one toe weight of the portion of said head weight means in said toe section serving as inertial weight for said toe section;

i. an upper toe section extending upward and a lower toe section extending downward, respectively, from a horizontal boundary in said toe section defined by a horizontal cut-plane positioned one-half the height of said clubhead from an extreme of said top of said clubhead;

j. an upper toe weight means comprising at least one upper toe weight of the portion of said toe weight means in said upper toe section serving as inertial weight for said upper toe section, and a lower toe weight means comprising at least one lower toe weight of the portion of said toe weight means in said lower toe section serving as inertial weight for said lower toe section;

k. a modified sectional weight distribution means to position between said ball striking surface toward said front and said back;

(i) a substantial percentage of said upper toe weight means as an increased upper concentration of mass in a predetermined fixed upper location adjacent said top and said toe, and a substantial percentage of said lower toe weight means as an increased lower concentration of mass in a predetermined fixed lower location adjacent said sole and said toe;

(ii) a middle volume directly between said increased upper and lower concentrations having a decreased middle concentration of said toe weight means substantially less concentrated than each of said increased upper and lower concentrations to substantially separate said increased upper concentration from said increased lower concentration; and (iii) an upper central volume directly between said increased upper concentration and said central boundary of said toe section having a decreased upper central concentration of said toe weight means substantially less concentrated than said increased upper concentration tending to separate said increased upper concentration from said central boundary; whereby j. polar moments of inertia of said clubhead are enhanced.

9. The golf clubhead of claim 8 having a ratio of masses between the mass of said toe weight means and the complete mass of said toe section of at least 0.10; and having a ratio of densities between the density of said toe weight means and the density of said body in said toe section of at least 1.20.

10. The golf clubhead of claim 9 whereby said ratio of masses is at least 0.50; and said ratio of densities is at least 4.0.

11. The golf clubhead of claim 9 whereby the density of the material of said toe weight means is at least 11.5 grams per cubic centimeter with a content of tungsten of at least 10 percent by weight.

12. The golf clubhead of claim 9 whereby the mass of said upper toe weight means is less than the mass of said lower toe weight means to control the vertical location of the center of mass of said clubhead.

13. The golf clubhead of claim 12 whereby the density of said upper toe weight means is less than the density of said lower toe weight means to control the vertical location of the center of mass of said clubhead.

14. The golf clubhead of claim 9 whereby:

a. the far extent toward said toe of said increased upper concentration of said upper toe weight means and the far extent toward said toe of said increased lower concentration of said lower toe weight means are each positioned within about one-fourth the length of said clubhead from the extreme of said toe;

b. the upper extent of said increased upper concentration toward said top and the lower extent of said increased lower concentration toward said sole are positioned within about one-fourth the height of said clubhead from the extreme of said top and an extreme of said sole of said clubhead, respectively;

c. said substantial percentage of said upper toe weight means as said increased upper concentration and said substantial percentage of said lower toe weight means as said increased lower concentration together represent one hundred percent of the mass of said toe weight means;

d. said increased upper concentration of mass is completely separated from said increased lower concentration of mass, and the lower extent of said increased upper concentration of mass toward said horizontal boundary is less than one-half of the height of said clubhead from the extreme of said top of said clubhead; and e. the central extent of said increased upper concentration toward said central boundary of said toe section is less than one-half the length of said clubhead from the extreme of said toe.

15. The golf clubhead of claim 14 whereby:

a. the length, width, and height of said increased upper concentration of mass are between about one-twentieth to one-third the length of said clubhead, one-tenth to nine-tenths the width of said clubhead, and one-twentieth to one-third the height of said clubhead; and b. both the length and the width of said increased upper concentration are greater than the height of said increased upper concentration.

16. The golf clubhead of claim 15 comprising:

a. an upper optimal edge approximately parallel to the width line of said clubhead positioned adjacent to said top and said toe within about one-fourth the height of said clubhead from the extreme of said top and within about one-fourth the length of said clubhead form the extreme of said toe, whereby a portion of said increased upper concentration most adjacent said top and said toe generally extends rearward along said upper optimal edge; and b. a lower optimal edge approximately parallel to the width line of said clubhead positioned adjacent said sole and said toe within about one-fourth the height of said clubhead from the extreme of said sole and within about one-fourth the length of said clubhead from the extreme of said toe, whereby a portion of said increased lower concentration most adjacent said sole and said toe generally extends rearward along said lower optimal edge.

17. The golf clubhead of claim 16 whereby the loft compression ratio of said upper toe weight means is at least 1.0 and the twist compression ratio of said upper toe weight means is at least 0.70; and whereby the loft compression ratio of said lower toe weight means is at least 1.0 and the twist compression ratio of said lower toe weight means is at least 0.70.

18. The golf clubhead of claim 16 whereby the mass of said upper toe weight means is less than the mass of said lower toe weight means to control the vertical location of the center of mass of said clubhead.

19. The golf clubhead of claim 18 whereby the density of said upper toe weight means is less than the density of said lower toe weight means to control the vertical location of the center of mass of said clubhead.

20. The golf clubhead of claim 19 whereby the density of the material of said toe weight means is at least 11.5 grams per cubic centimeter with a content of tungsten of at least 10 percent by weight.

* * * * *

UNITED STATES PATENT AND TRADEMARK OFFICE

CERTIFICATE OF CORRECTION

PATENT NO. : 4,984,799

DATED : January 15, 1991

INVENTOR(S) : Clifton D. Finney

It is certified that error appears in the above-identified patent and that said Letters Patent is hereby corrected as shown below:

| | |
|---|---|
| Title page, inventor line, | change "4057 Oak Hills" to --1057 Oak Hills--. |
| Col. 26, line 60 | after "distribution" insert --means--. |

Signed and Sealed this

Seventh Day of July, 1992

*Attest:*

*Attesting Officer*

DOUGLAS B. COMER

*Acting Commissioner of Patents and Trademarks*